US005582539A

United States Patent [19]

Wang

[11] Patent Number: 5,582,539

[45] Date of Patent: Dec. 10, 1996

[54] FEEDING MECHANISM FOR A SANDER

[76] Inventor: Tian-Wang Wang, No. 45, Yi Chang East Road, Tai Ping Hsiang, Taichung Hsien, Taiwan

[21] Appl. No.: 496,059

[22] Filed: Jun. 28, 1995

[51] Int. Cl.[6] ..... B24B 7/28

[52] U.S. Cl. ..... 451/188; 451/358

[58] Field of Search ..... 451/182, 188, 451/178, 207, 131, 301, 331, 358, 545, 914, 177

[56] References Cited

U.S. PATENT DOCUMENTS

| | | | |
|---|---|---|---|
| 82,780 | 10/1868 | Wooster | 451/188 |
| 207,717 | 9/1878 | Creager | 451/188 |
| 347,125 | 8/1886 | Perry | 451/188 |
| 421,487 | 2/1890 | Fisher | 451/188 |
| 2,463,750 | 3/1949 | Curtin | 451/188 |
| 3,570,186 | 3/1971 | Kulwicki | 451/188 |

*Primary Examiner*—Robert A. Rose
*Attorney, Agent, or Firm*—Charles E. Baxley, Esq.

[57] ABSTRACT

A sander includes a work table for supporting a work piece and having a frame secured on one end. A housing has one end slidably engaged in the frame and movable upward and downward toward the work table. A motor is secured to the housing and has a spindle extended inward of the housing. A sander member is secured to the spindle so as to be driven by the motor with a greater speed for grinding the work piece. One or more rollers are rotatably coupled to the spindle by a reduction gearing so as to move the work piece with the reduced speed.

1 Claim, 3 Drawing Sheets

FEEDING MECHANISM FOR A SANDER

BACKGROUND OF THE INVENTION

1. Field of the Invention

The present invention relates to a sander, and more particularly to a feeding and grinding mechanism for a sander.

2. Description of the Prior Art

Typical sanders comprise a work table for supporting the work pieces and a grinding mechanism for grinding and sanding the work pieces. Normally, the work pieces are sent and moved forward so as to be ground by the grinding mechanism. Alternatively, a feeding mechanism may be provided in the work table for feeding the work pieces. However, another motor is required to drive the feeding mechanism, and the users have to operate both the grinding mechanism and the feeding mechanism simultaneously.

The present invention has arisen to mitigate and/or obviate the afore-described disadvantages of the conventional feeding mechanism of the sanders.

SUMMARY OF THE INVENTION

The primary objective of the present invention is to provide a sander which includes a feeding and grinding mechanism that may feed the work piece and may grind the work piece simultaneously.

In accordance with one aspect of the invention, there is provided a sander comprising a work table including one end having a frame secured thereon, track means vertically provided in the frame, a housing including a first end slidably-engaged with the track means so as to move upward and downward along the track means, means for moving the housing upward and downward along the track means, a motor secured to the housing and including a spindle extended inward of the housing, a sander member rotatably supported in the housing and secured to the spindle so as to be driven by the motor for grinding the work piece, at least one roller rotatably supported in the housing for engaging with the work piece and for moving the work piece, and reduction gearing means coupling the spindle to the roller so as to drive the roller with a reduced rotational speed and so as to move the work piece with the reduced rotational speed.

The moving speed includes a bolt rotatably and vertically supported in the frame and threadedly engaged with the housing, so as to move the housing upward and downward along the bolt when the bolt is rotated. The bolt includes a first end extended upward beyond the frame and includes a hand wheel secured to the first end for rotating the bolt.

The reduction gearing means includes a first pinion secured on the spindle, a first gear rotatably supported in the housing, and at least one second gear and at least one second pinion secured together and engaged with the first pinion and the first gear respectively, and means for coupling the first gear to the roller in order to drive the roller with the reduced rotational speed. The coupling means includes a first sprocket secured to the first gear, a second sprocket secured on the roller, and a chain means coupling the first and second sprockets together.

The sander comprises two rollers each including a sprocket secured thereon, and a chain means coupling the sprockets together so as to rotate the rollers simultaneously.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
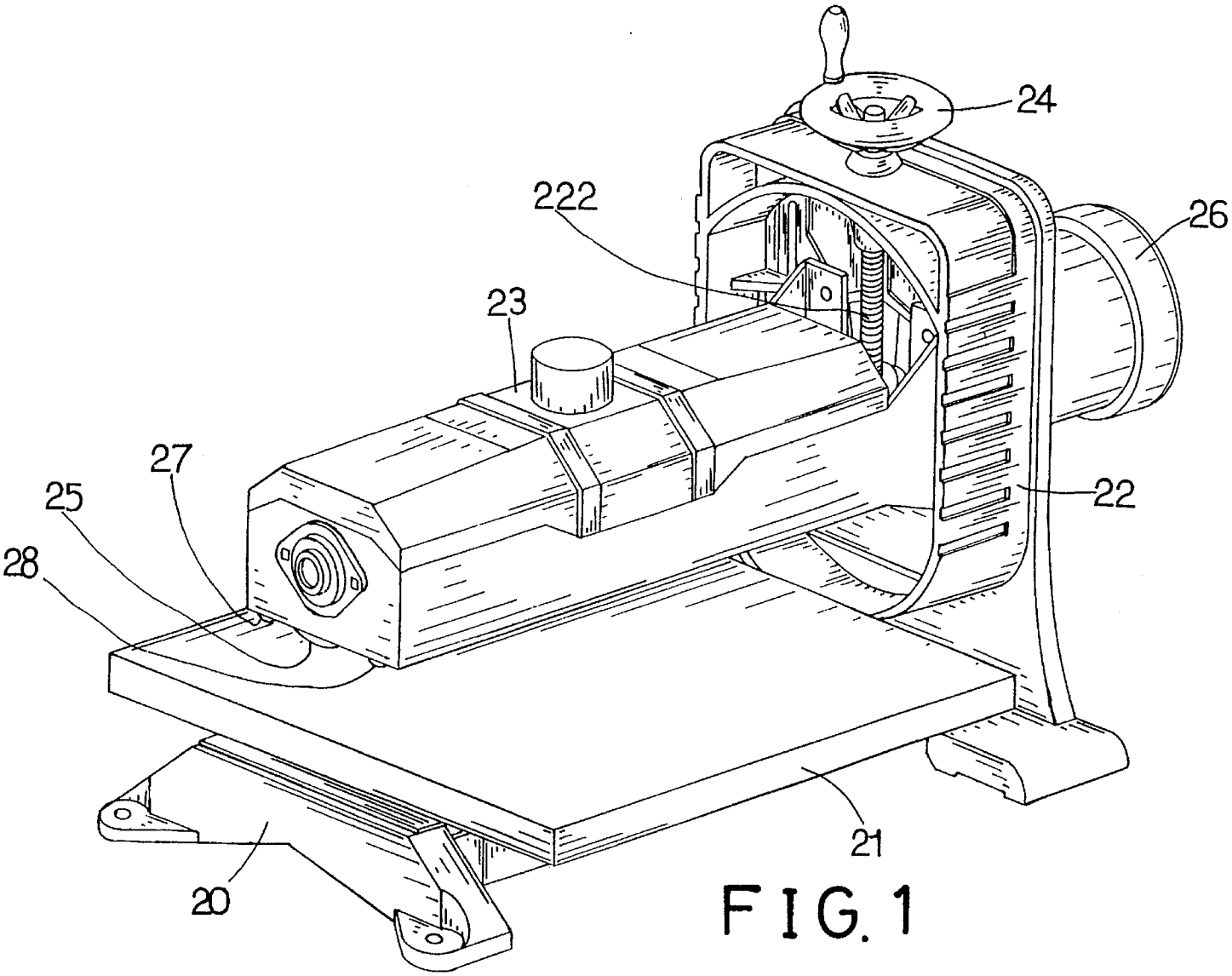
FIG. 1 is a perspective view of a sander in accordance with the present invention.
Figure 2:
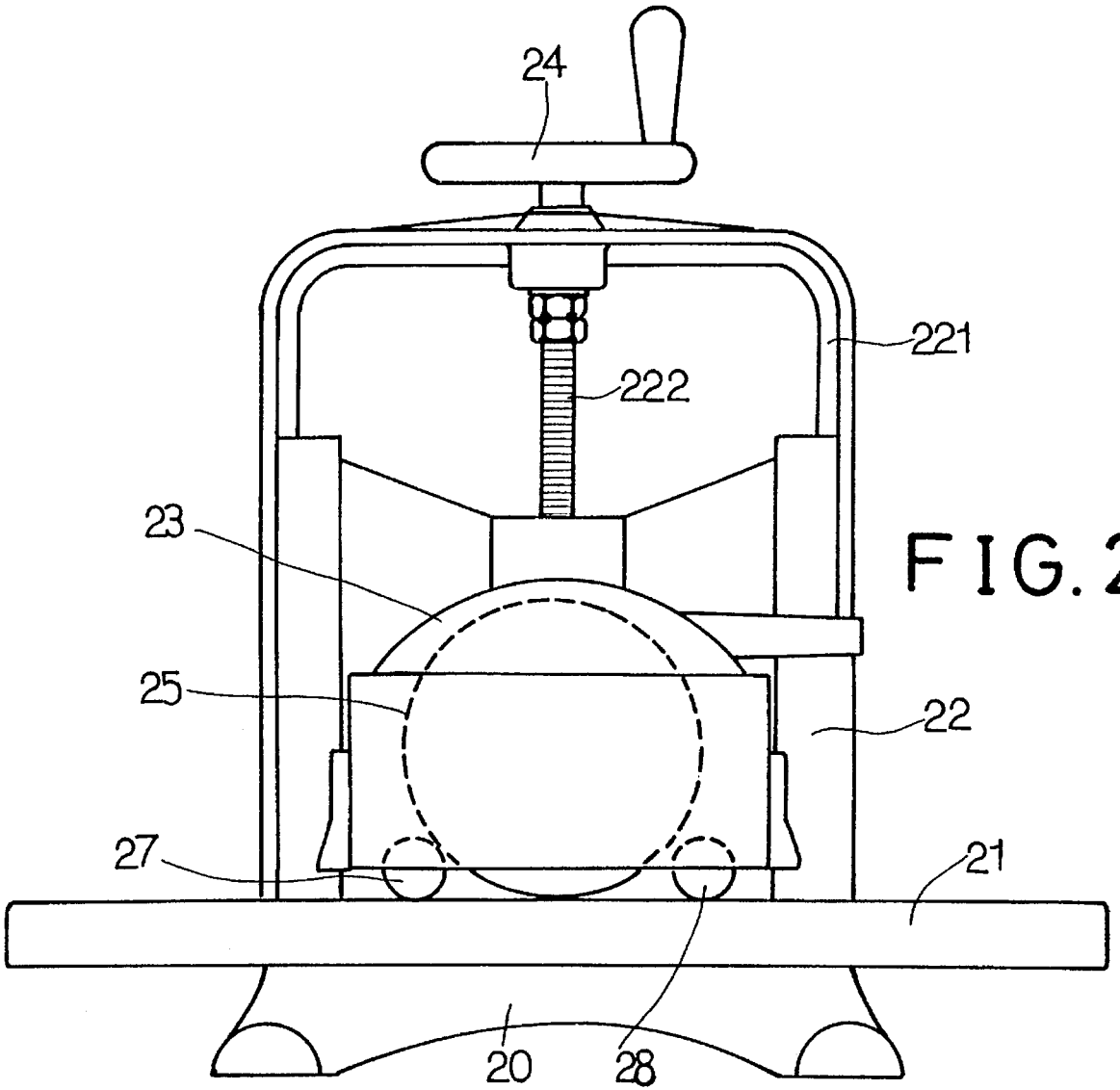
FIG. 2 is a front view of the sander.

Referring to the drawings, and initially to FIGS. 1 and 2, a sander in accordance with the present invention comprises a base 20 including a work table 21 secured thereon and including a frame 22 extended upward from one end of the base 20. A housing 23 includes one end slidably engaged with a pair of vertical track means 221 such that the housing 23 may be moved either upward or downward along the track means 221. A bolt 222 is rotatably supported in the frame 22 and threadedly engaged with the one end of the housing 23 and includes an upper end extended upward through the frame 22 and having a hand wheel 24 secured thereto such that the bolt 222 may be rotated by the hand wheel 24 in order to move the housing 23 upward and downward relative to the work table 21.

Referring next to FIGS. 3 and 4, and again to FIGS. 1 and 2, a motor 26 includes a spindle 30 extended inward of the housing 23 and is secured to the housing 23 such that the motor 26 moves upward and downward in concert with the housing 23. A sander wheel 25 is rotatably supported in the housing 23 and secured to the spindle 30 so as to be driven by the motor 26. A clutch means 31 may be provided and engaged between the spindle 30 and the sander wheel 25 for engaging the sander wheel 25 with the spindle 30 or for disengaging the sander wheel 25 from the spindle 30. Two rollers 27, 28 are rotatably supported in the housing 23 and are preferably arranged in parallel with each other and arranged on both sides of the sander wheel 25, best shown in FIG. 4. The rollers 27, 28 each includes a sprocket 41, 42 secured thereon for engaging with a chain 40 which may rotate the sprockets 41, 42 and the rollers 27, 28 simultaneously.

Figure 3:
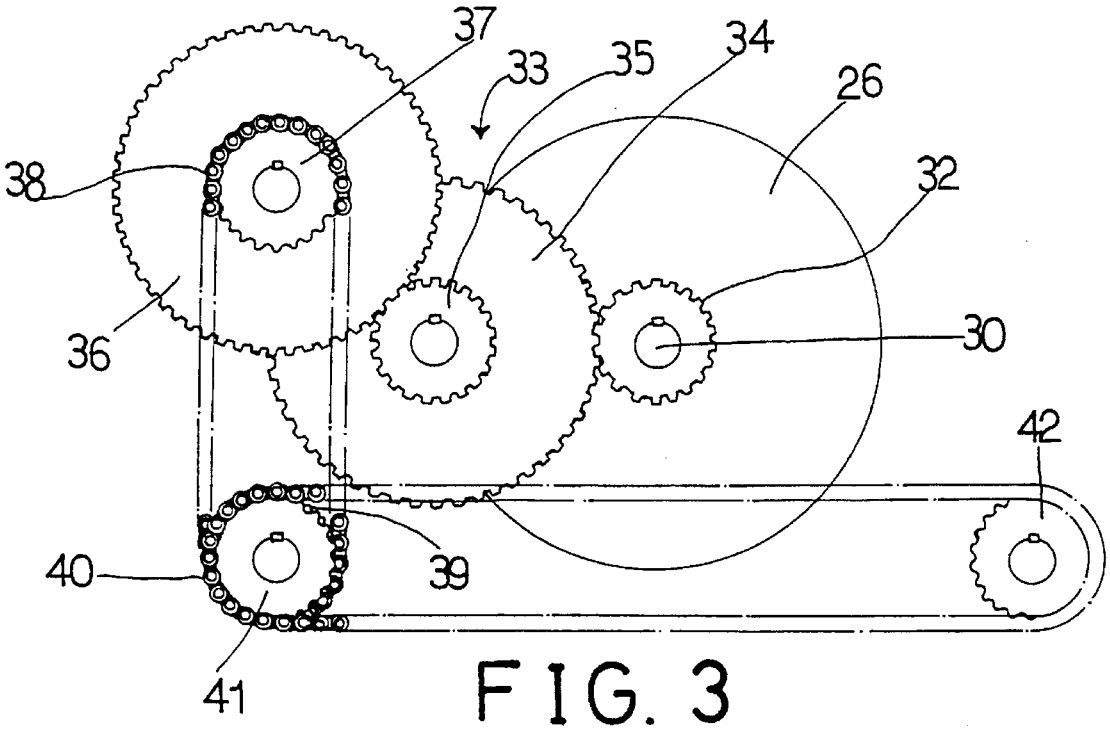
FIG. 3 is a plane schematic view illustrating the reduction gearing of the sander.
Figure 4:
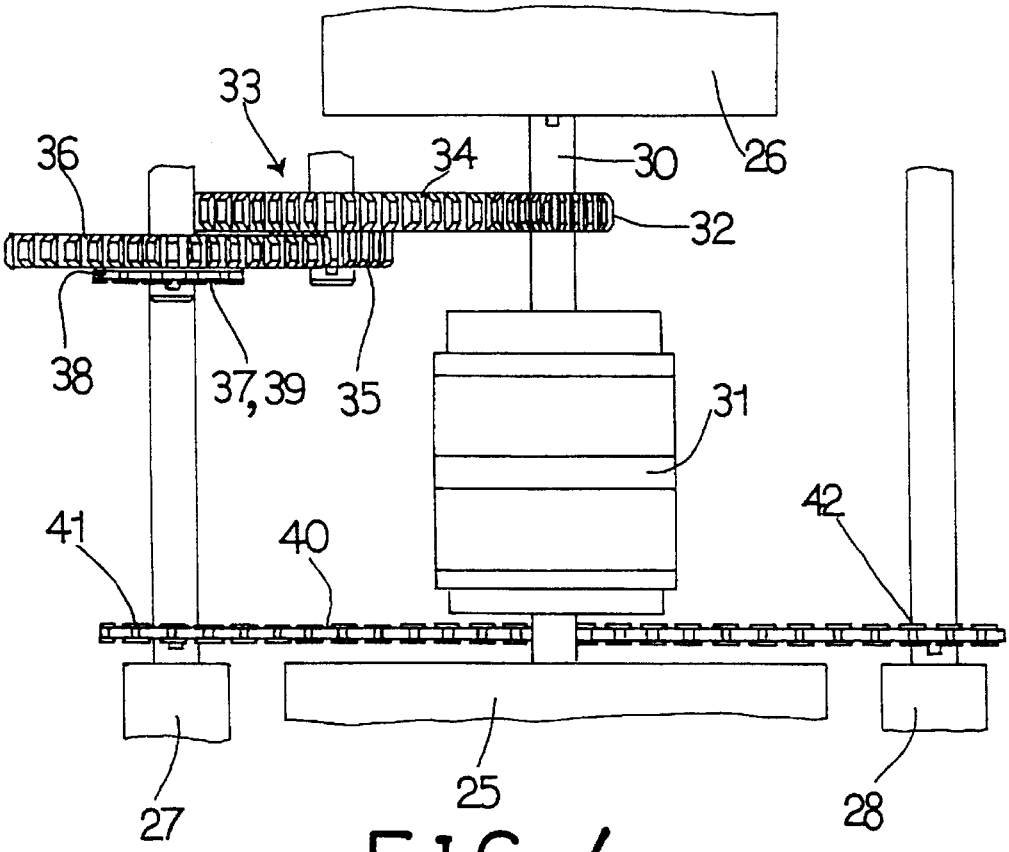
FIG. 4 is a top plane view illustrating the reduction gearing of the sander.

As best shown in FIGS. 3 and 4, the spindle 30 includes a pinion 32 secured thereon for engaging with a reduction gearing 33. The reduction gearing 33 includes a gear 34 engaged with the pinion 32 and having a pinion 35 secured thereto. The pinion 35 is engaged with a gear 36 which is rotatably supported in the housing 23. The gear 36 includes a sprocket 37 secured thereon and coupled to another sprocket 39 by a chain 38. The sprocket 39 is secured on the roller 27 such that the rollers 27, 28 may be rotated by the motor 26 with a reduced speed as compared with the rotational speed of the spindle 30 and the sander wheel 25.

In operation, as shown in FIGS. 2 and 4, a work piece may be supported on the work table 21 and the housing 23 may be moved downward by the hand wheel 24 so as to engage the sander wheel 25 and the rollers 27, 28 with the work piece. The rollers 27, 28 may be moved forward by a reduced rotational speed via the reduction gearing 33 such that the work piece may be fed forward with a suitable speed. However, the sander wheel 25 which is directly secured to the spindle 30 of the motor 26 may be driven with a greater rotational speed so as to conduct grinding operations to the work piece. It is only required for the users to move the housing 23 downward toward the work piece by the hand wheel 24 such that the sander may be easily operated.

Accordingly, the sander in accordance with the present invention includes a sander wheel and a pair of rollers that may be driven by a single motor. In addition, the sander wheel may be rotated with greater speed for conducting grinding operations, and the rollers may be rotated with reduced speed so as to feed the work pieces with a suitable speed.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A sander comprising:

a work table for supporting a work piece, said work table including one end having a frame secured thereon, track means vertically provided in said frame, a housing including a first end slidably engaged with said track means so as to move upward and downward along said track means, means for moving said housing upward and downward along said track means, said moving means including a bolt rotatably and vertically supported in said frame and threadedly engaged with said housing, so as to move said housing upward and downward along said bolt when said bolt is rotated, said bolt including a first end extended upward beyond said frame and including a hand wheel secured to said first end thereof for rotating said bolt, a motor secured to said housing and including a spindle extended inward of said housing, a sander member rotatably supported in said housing and secured to said spindle so as to be driven by said motor for grinding the work piece, at least one roller rotatably supported in said housing for engaging with the work piece and for moving the work piece, and reduction gearing means coupling said spindle to said roller so as to drive said roller with a reduced rotational speed and so as to move the work piece with the reduced speed, said reduction gearing means including a first pinion secured on said spindle, a first gear rotatably supported in said housing, and at least one second gear and at least one second pinion secured together and engaged with said first pinion and said first gear respectively, and coupling means including a first sprocket secured to said first gear, a second sprocket secured on said roller, and a chain means coupling said first and second sprockets together.

* * * * *